US008522381B1

(12) United States Patent
Smith

(10) Patent No.: US 8,522,381 B1
(45) Date of Patent: Sep. 3, 2013

(54) SYSTEM AND METHOD FOR BRIDGE PIER REPLACEMENT

(75) Inventor: Thomas Alan Smith, Columbia, MO (US)

(73) Assignee: OCCI, Inc., Fulton, MO (US)

( * ) Notice: Subject to any disclaimer, the term of this patent is extended or adjusted under 35 U.S.C. 154(b) by 0 days.

(21) Appl. No.: 13/227,318

(22) Filed: Sep. 7, 2011

Related U.S. Application Data

(60) Provisional application No. 61/380,670, filed on Sep. 7, 2010.

(51) Int. Cl.
*E01D 21/00* (2006.01)

(52) U.S. Cl.
USPC ..... 14/75; 14/77.1; 52/745.18

(58) Field of Classification Search
USPC ..... 14/75, 77.1, 77.3; 52/745.17, 745.18
See application file for complete search history.

(56) References Cited

U.S. PATENT DOCUMENTS 3,776,498 A * 12/1973 Peters et al. ..... 248/219.1
4,040,774 A * 8/1977 Scheller ..... 425/65
5,511,266 A * 4/1996 Dinis ..... 14/2.5
5,960,502 A * 10/1999 Sherman et al. ..... 14/77.1
6,416,258 B1 * 7/2002 Chang ..... 405/272
7,070,158 B1 * 7/2006 Gamble ..... 249/20
7,748,195 B2 * 7/2010 Keith ..... 52/745.21

FOREIGN PATENT DOCUMENTS

JP 1-290806 * 11/1989

* cited by examiner

*Primary Examiner* — Gary Hartmann
(74) *Attorney, Agent, or Firm* — Bryan Cave LLP

(57) ABSTRACT

A system and method for replacing existing deteriorated piers of bridges in the same location as the existing pier, without the use of temporary bents comprising the steps of: installing one or more drilled shaft, preferably round, columns in the earth on opposite sides of the existing pier to be replaced transverse to the axis of the bridge; installing at least one temporary support bracket or embedded support beam on each of the columns; installing a temporary transverse girder onto the support brackets or beams of two columns; installing temporary support posts on the transverse girder; transferring the load from the pier to the temporary transverse girders once the columns have attained adequate strength; removing the pier to an elevation below the cap; constructing a new cap; transferring the load from the temporary girders to the new cap once the cap has attained adequate strength; and removing the temporary supports.

17 Claims, 8 Drawing Sheets

SYSTEM AND METHOD FOR BRIDGE PIER REPLACEMENT

CROSS-REFERENCE TO RELATED APPLICATIONS

This application claims benefit of priority under 35 U.S.C. Section 119(e) to U.S. Provisional Application Ser. No. 61/380,670, filed Sep. 7, 2010, entitled "SYSTEM AND METHOD FOR BRIDGE PIER REPLACEMENT," which is hereby incorporated herein by reference.

BACKGROUND OF THE INVENTION

1. Field of the Invention

The present invention relates generally to a system and method for replacing existing deteriorated piers of bridges which carry railroad or other types of traffic without interruption to traffic flow or temporary intermediate piers.

2. Description of the Related Art

Typical railroad or other type bridge construction involves the use of bridge girders, which are oriented in the general direction of the axis of the railroad or road which is supported by the bridge. The bridge girders are typically supported at each end by a pier, which provides support into the earth for the bridge and the applied load. The existing bridge piers are generally constructed of reinforced concrete, masonry, structural steel, or a combination thereof, often comprising two or more columns or column-like members connected at their top-most ends by a cap, strut, or other member holding them in their correct positions. Conventional methods for replacing existing deteriorated piers of bridges require the interruption to traffic flow.

SUMMARY OF THE INVENTION

The system and method of the present invention comprises installing new drilled shaft columns outside (wider than) the existing pier or bent. Integral to these columns will be support brackets or embedded support beams. Temporary girders are installed on these support brackets or beams, and the load is transferred from the existing bent to the temporary transverse girders. With the bridge girders supported by the temporary transverse girders, the existing deteriorated bent can be removed, and a new cast in place pier cap can be constructed on the new drilled shaft columns. The load can then be transferred to the new cap and the temporary support brackets or beams and transverse girders can be removed.

DETAILED DESCRIPTION OF THE INVENTION

Figure 1:
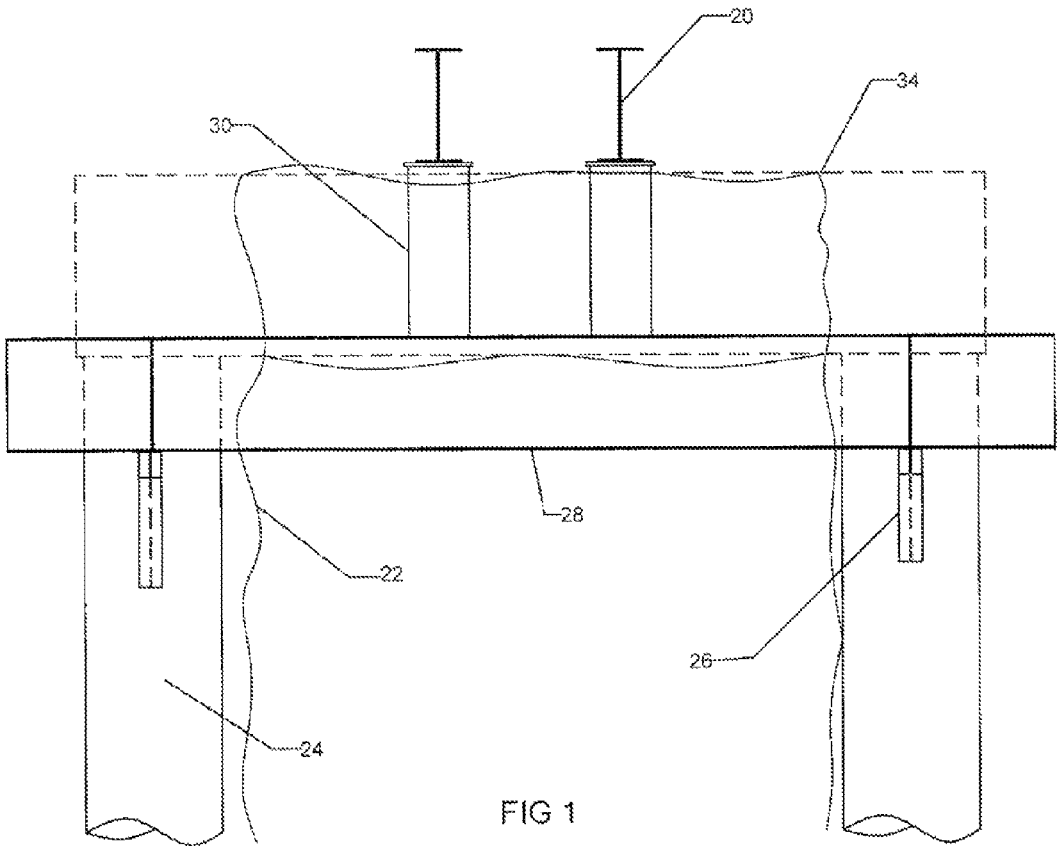
FIG. 1 is a cross-sectional view of one embodiment of the present invention prior to the installation of the new pier cap.

As illustrated in FIG. 1, a typical railroad or other type bridge construction involves the use of bridge girders 20, which are oriented in the general direction of the axis of the railroad or road which is supported by the bridge. The bridge girders are typically supported at each end by a pier or bent 22 which provides support into the earth for the bridge and the applied load. The bridge piers 22 are generally are constructed of reinforced concrete, often comprising two or more columns or column-like members connected at their top most ends by a cap, strut, or other member holding them in their correct positions. The pier or capping structure 22 will often have an elongated rectangular footprint with the long axis of the footprint oriented transverse to the axis of the bridge girders 20. When a bridge pier 22 becomes deteriorated to the point that it is no longer serviceable, in order to maintain the integrity and use of the bridge structure, it is desirable to provide a replacement support structure without interruption of the use of the bridge structure.

Figure 3:
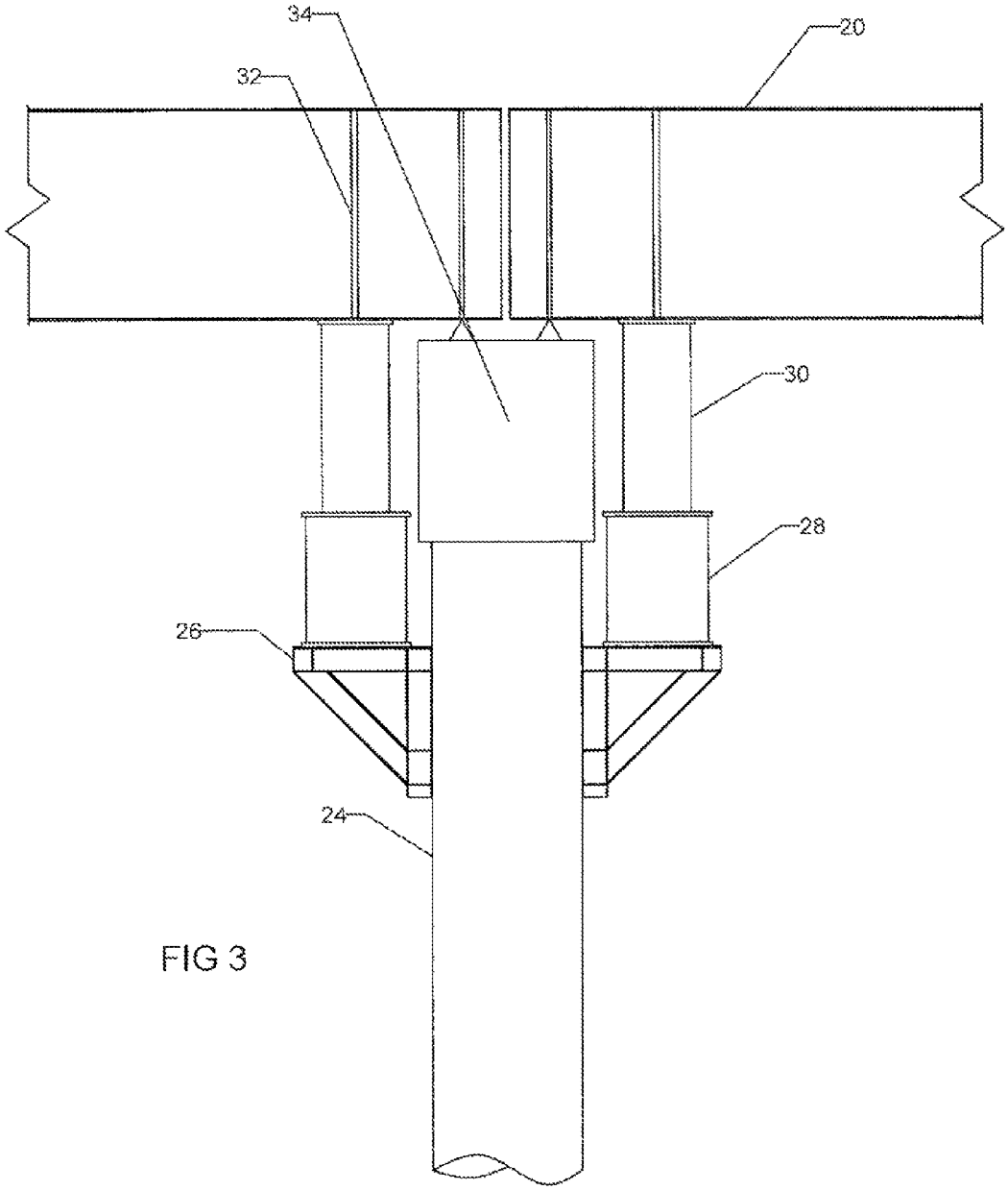
FIG. 3 is a side view of one embodiment of the present invention with the new pier cap in place.
Figure 4:
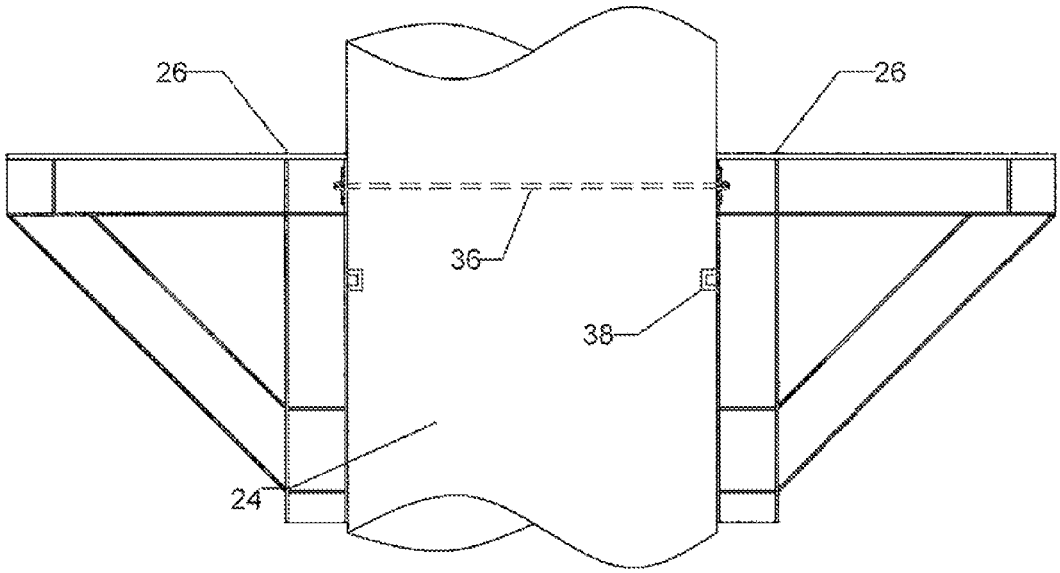
FIG. 4 is a cross-sectional view of a new support column illustrating the temporary support brackets attached to the column using tension rods and shear keys.

As illustrated in FIGS. 1, 3 and 4, in one embodiment, the present method and system preferably involves the installation of new permanent drilled shaft columns 24 preferably of a round configuration, outside of the existing pier 22, preferably one at each end of the pier 22 with centerlines oriented along the pier footprint axis, transverse to the axis of the bridge girders 20. Once the new drill shaft columns 24 are installed, they are each fitted with at least one temporary support bracket 26 which preferably extends from each new support column 24 in a direction along the bridge girder axis.

As illustrated in FIG. 4, the temporary support brackets 26 may be attached to the new support column 24 using tension rods 36, shear keys 38 embedded in the new support column 24, or a combination of tension rods and shear keys. As is known by those of ordinary skill in the art, tension rods 36 may be installed through the column 24 as illustrated in FIG. 4, or, alternatively, tension rods 36 may be tied to a nut embedded in the new support column 24.

As illustrated in FIGS. 1 and 3, the temporary support brackets 26 are configured to receive and support a temporary girder 28, which spans between the temporary support brackets 26 on both of the new drilled shaft columns 24 along an axis transverse to the axis of the bridge girders 20.

As illustrated in FIGS. 1 and 3, a temporary support post 30 may be installed on the upper surface of the temporary girder 28 underneath each existing bridge girder 20, to provide support for the existing bridge girders 20 at a point on the girder inside from the point where the deteriorated pier 22 currently supports the girder 20. In this manner, the temporary support post 30 or other suitable supporting device may be jacked into position in order to transfer the load from the deteriorated pier 22 to the transverse girders 28 supported by the temporary support brackets 26 on the new support columns 24. The existing bridge girder 20 may be fitted with a temporary bearing stiffener 32 to provide local reinforcement of the bridge girder 20 to adequately transfer the bridge load to the temporary support post 30.

As illustrated in FIGS. 1 and 3, this arrangement allows the load on the bridge girder 20 to be adequately supported by the temporary support post 30 and transverse girder 28 such that the upper portion of the existing pier 22 may be removed to allow the installation of a new cast in place concrete pier cap 34 or replacement of the deteriorated portion of the pier, while the continued existing use of the bridge structure is maintained.

Figure 2:
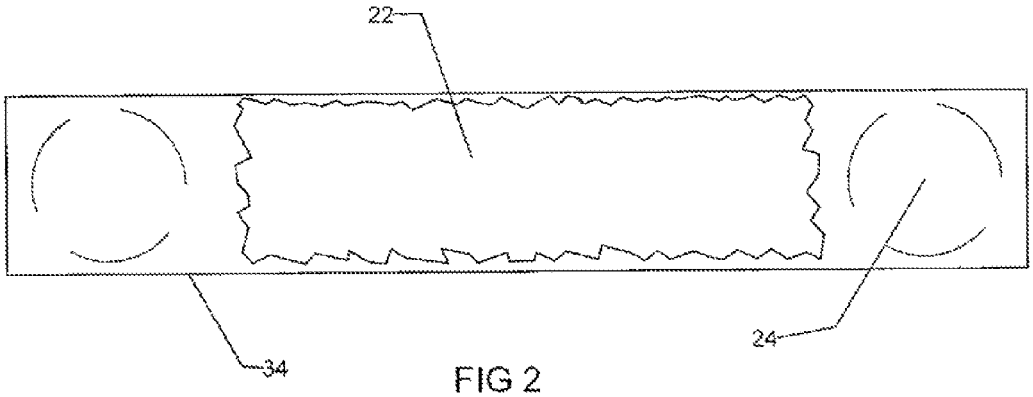
FIG. 2 is an overhead plan view of one embodiment of the present invention illustrating the new pier cap in place.

As illustrated in FIGS. 1, 2 and 3, once the bridge girder 20 is supported by the temporary support post 30 and transverse girder 28, the new support columns 24 may be fitted with a new cast in place concrete cap 34, which extends between the columns 24 over the area previously supported by the deteriorated pier 22 such that the new columns 24 and cap 34 may replace the load bearing function for the bridge girder 20 of the deteriorated pier at the same location on the bridge girder 20. The new pier cap 34 is of sufficient dimensions and materials to provide support between the new columns 24 such that even in the absence of any support from the deteriorated pier 22, the bridge will be supported. The new pier cap 34 is installed in substantially the same location and above the deteriorated pier 22 so that the original support locations on the bridge girders 20 are employed. Once the cap 34 has attained adequate strength, the bridge load from the bridge girders 20 may be transferred from the temporary support post 30 and transverse girder 28 to the new concrete cap 34. Then, if desired, the temporary support brackets 26, temporary support posts 30 and transverse girders 28 may be removed.

As is known and appreciated by those of ordinary skill in the art, other suitable structures may be used in place of a pier cap for spanning between the new columns 24 for supporting the bridge girders 20, including structural steel beams, girders, or trusses.

In summary, a detailed description of the steps of a method of employing one embodiment of the preferred invention is as follows:

- Install one or more, preferably round drilled shaft columns in the earth on opposite sides of the existing pier to be replaced transverse to the axis of the bridge girder.
- Install at least one temporary support bracket on each of the new columns.
- Install a temporary transverse girder onto the support brackets of two or more columns.
- Install temporary support posts on the transverse girder.
- Once the columns have attained adequate strength, transfer the load from existing deteriorated pier to the temporary transverse girder using the temporary support post.
- Remove the existing pier or bent down to an elevation as necessary to allow installation of a new cast in place cap.
- Construct a new cast in place cap.
- Once the cap has attained adequate strength, transfer the load from the temporary transverse girders and temporary support posts to the new cast in place concrete cap.
- Remove the temporary transverse girder, temporary support posts and temporary support brackets.

Figure 5:
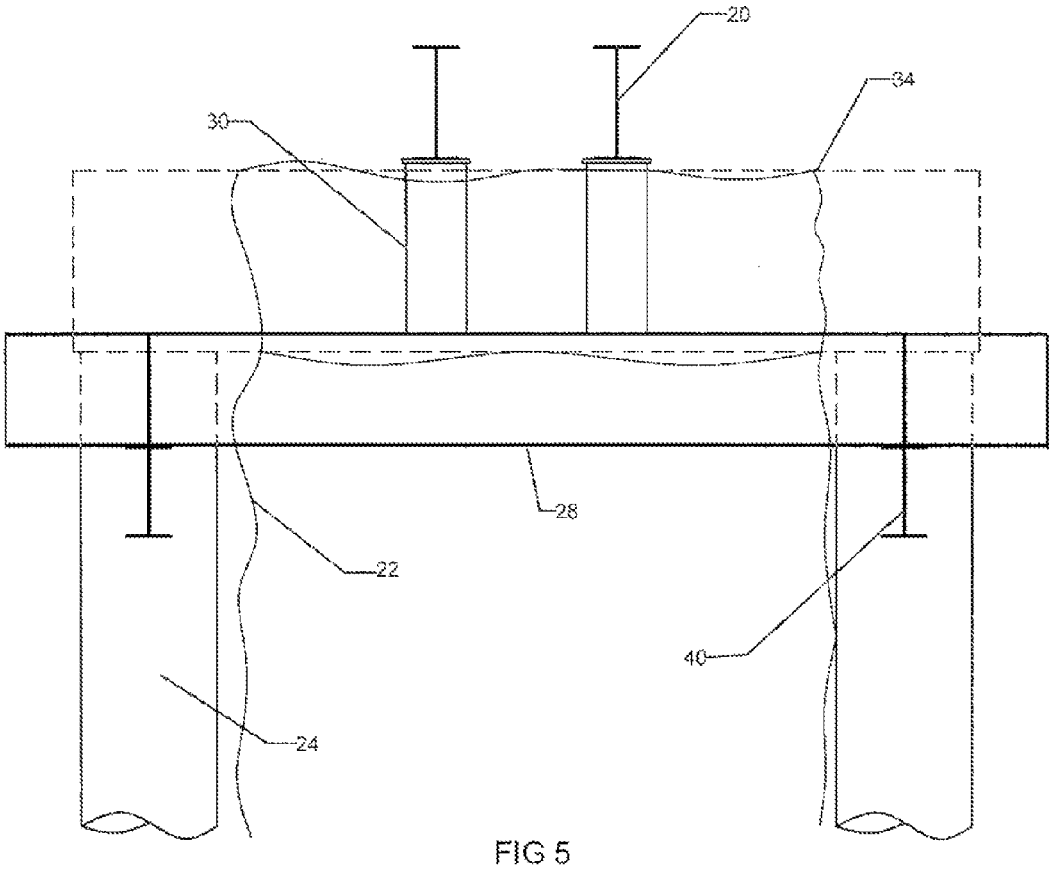
FIG. 5 is a cross-sectional view of another embodiment of the present invention prior to the installation of the new pier cap.
Figure 7:
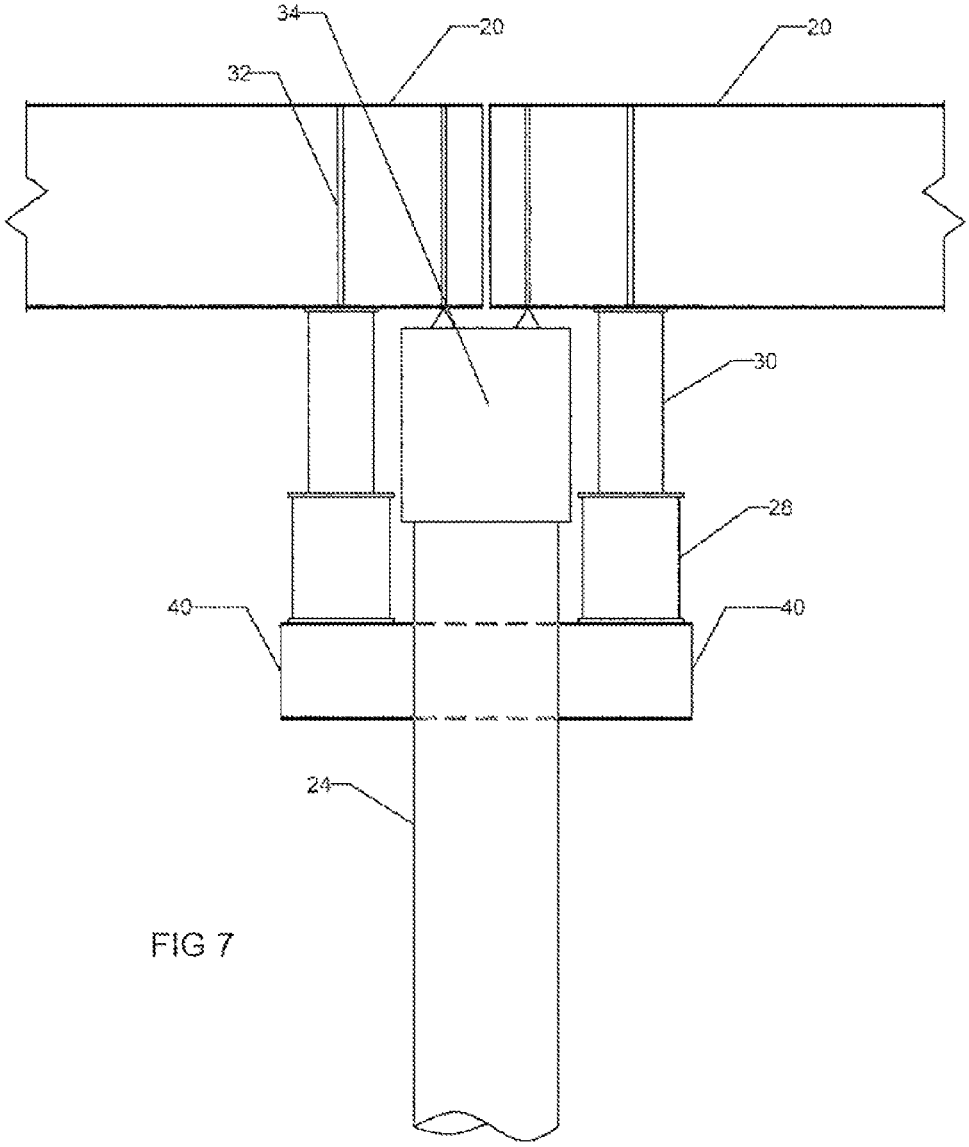
FIG. 7 is a side view of another embodiment of the present invention with the new pier cap in place.
Figure 8:
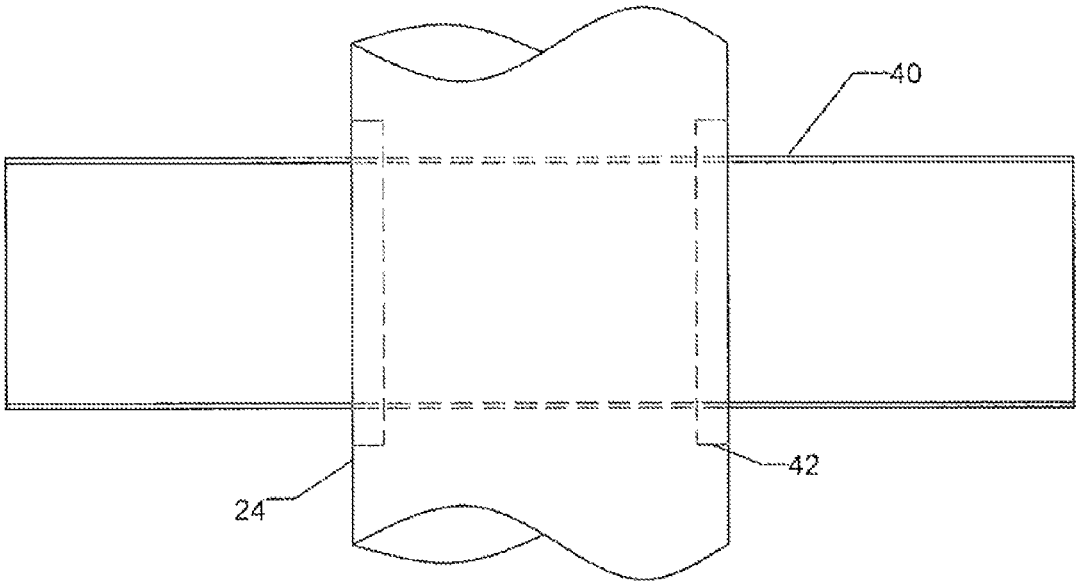
FIG. 8 is a cross-sectional view of a new support column of another embodiment of the present invention illustrating the temporary support beam embedded in the column.

As illustrated in FIGS. 5, 7 and 8, in another embodiment, the present method and system preferably involves the installation of new permanent drilled shaft columns 24 preferably of a round configuration, outside of the existing pier 22, preferably one at each end of the pier 22 with centerlines oriented along the pier footprint axis, transverse to the axis of the bridge girders 20. When the new drill shaft columns 24 are formed, at least one temporary support beam 40 is embedded through each new support column 24 oriented in a direction along the bridge girder axis.

As illustrated in FIGS. 5 and 7, the temporary support beams 40 are configured to receive and support a temporary girder 28, which spans between the temporary support beams 40 on both of the new drilled shaft columns 24 along an axis transverse to the axis of the bridge girders 20.

As illustrated in FIGS. 5 and 7, a temporary support post 30 may be installed on the upper surface of the temporary girder 28 underneath each existing bridge girder 20, to provide support for the existing bridge girders 20 at a point on the girder inside from the point where the deteriorated pier 22 currently supports the girder 20. In this manner, the temporary support post 30 or other suitable supporting device may be jacked into position in order to transfer the load from the deteriorated pier 22 to the transverse girders 28 supported by the temporary support beams 40 on the new support columns 24. The existing bridge girder 20 may be fitted with a temporary bearing stiffener 32 to provide local reinforcement of the bridge girder 20 to adequately transfer the bridge load to the temporary support post 30.

As illustrated in FIGS. 5 and 7, this arrangement allows the load on the bridge girder 20 to be adequately supported by the temporary support post 30 and transverse girder 28 such that the upper portion of the existing pier 22 may be removed to allow the installation of a new cast in place concrete pier cap 34 or replacement of the deteriorated portion of the pier, while the continued existing use of the bridge structure is maintained.

Figure 6:
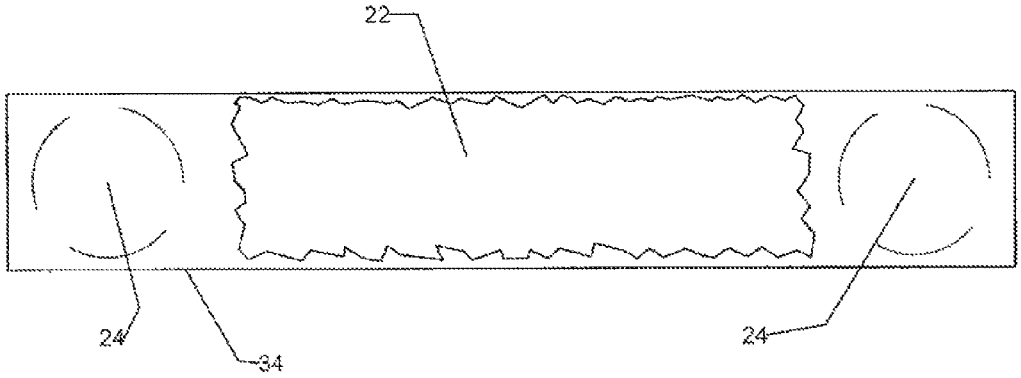
FIG. 6 is an overhead plan view of another embodiment of the present invention illustrating the new pier cap in place.

As illustrated in FIGS. 5, 6 and 7, once the bridge girder 20 is supported by the temporary support post 30 and transverse girder 28, the new support columns 24 may be fitted with a new cast in place concrete cap 34, which extends between the columns 24 over the area previously supported by the deteriorated pier 22 such that the new columns 24 and cap 34 may replace the load bearing function for the bridge girder 20 of the deteriorated pier at the same location on the bridge girder 20. The new pier cap 34 is of sufficient dimensions and materials to provide support between the new columns 24 such that even in the absence of any support from the deteriorated pier 22, the bridge will be supported. The new pier cap 34 is installed in substantially the same location and above the deteriorated pier 22 so that the original support locations on the bridge girders 20 are employed. Once the cap 34 has attained adequate strength, the bridge load from the bridge girders 20 may be transferred from the temporary support post 30 and transverse girder 28 to the new concrete cap 34. Then, if desired, the temporary support posts 30 and transverse girders 28 may be removed.

Additionally, as illustrated in FIG. 8, the portions of the temporary support beam 40 that extend beyond the face of column 24 may be removed. Optionally, a blockout 42 may be formed in column 24 to a depth of approximately 2 inches to facilitate removal of a portion of the embedded temporary support beam 40 below the face of column 24. After removal of the portion of the embedded temporary support beam 40 from within blockout 42, the resulting void in blockout 42 may be filled in with grout or other suitable material to produce a uniform surface on the face of column 24.

In summary, a detailed description of the steps of a method of employing such another embodiment of the preferred invention is as follows:

- Install one or more, preferably round drilled shaft, columns in the earth on opposite sides of the existing pier to be replaced transverse to the axis of the bridge girder, each column having a support beam cast-through it.
- Install a temporary transverse girder onto the support beams of two or more columns.
- Install a temporary support post on the transverse girder.
- Once the columns have attained adequate strength, transfer the load from existing deteriorated pier to the temporary transverse girder using the temporary support post.
- Remove the existing pier or bent down to an elevation as necessary to allow installation of a new cast in place cap.

Construct a new cast in place cap.

Once the cap has attained adequate strength, transfer the load from the temporary transverse girders and temporary support posts to the new cast in place concrete cap.

Remove the temporary transverse girder and temporary support posts.

Remove the portions of the support beam that extend beyond column face and within the blockout.

These examples are provided for the purposes of illustration and the present invention is not limited to them.

What is claimed is:

1. An apparatus for replacing a bridge pier which supports a bridge girder, the apparatus comprising:

at least two replacement columns installed in openings in the earth on opposite sides of the pier transverse to the axis of the bridge girder;

a temporary support bracket installed on each column;

a temporary transverse girder suspended between and supported by the support brackets; and a temporary support post positioned between the top of the transverse girder and the underside of the bridge girder.

2. The apparatus of claim 1 further comprising a cap spanning the columns beneath the bridge girder.

3. The apparatus of claim 2 wherein the cap is comprised of reinforced concrete.

4. The apparatus of claim 2 wherein the cap is comprised of a structural steel member.

5. An apparatus for replacing a bridge pier which supports a bridge girder, the apparatus comprising:

at least two replacement columns installed in openings in the earth on opposite sides of the pier transverse to the axis of the bridge girder;

a temporary support beam partially embedded within each column;

a temporary transverse girder suspended between and supported by the support beams; and a temporary support post positioned between the top of the transverse girder and the underside of the bridge girder.

6. The apparatus of claim 5 further comprising a cap spanning the columns beneath the bridge girder.

7. The apparatus of claim 6 wherein the cap is comprised of reinforced concrete.

8. The apparatus of claim 6 wherein the cap is comprised of a structural steel member.

9. A method for replacing a bridge pier which supports a bridge girder, the method comprising the steps of:

installing at least two replacement columns in openings in the earth on opposite sides of the pier transverse to the axis of the bridge girder;

installing at least one temporary support bracket on each column;

spanning a temporary transverse girder across the support brackets;

positioning a temporary support post on the top of the transverse girder to support the underside of the bridge girder;

removing an upper portion of the pier;

installing a cap spanning the columns beneath the bridge girder; and transferring the load from the temporary support post and transverse girder to the new concrete cap.

10. The method of claim 9 further comprising the step of removing the temporary support post, transverse girder and support brackets.

11. The method of claim 9 wherein the cap is comprised of reinforced concrete.

12. The method of claim 9 wherein the cap is comprised of a structural steel member.

13. A method for replacing a bridge pier which supports a bridge girder, the method comprising the steps of:

installing at least two replacement columns in openings in the earth on opposite sides of the pier transverse to the axis of the bridge girder;

partially embedding within each column at least one temporary support beam;

spanning a temporary transverse girder across the support beams;

positioning a temporary support post on the top of the transverse girder to support the underside of the bridge girder, removing an upper portion of the pier;

installing a cap spanning the columns beneath the bridge girder; and transferring the load from the temporary support post and transverse girder to the new concrete cap.

14. The method of claim 13 further comprising the step of removing the temporary support post and transverse girder.

15. The method of claim 14 further comprising the step of removing a portion of the temporary support beams.

16. The method of claim 13 wherein the cap is comprised of reinforced concrete.

17. The method of aim 13 wherein the cap is comprised of a structural steel member.

* * * * *